US005181305A

United States Patent [19]

Ozaki et al.

[11] Patent Number: 5,181,305

[45] Date of Patent: Jan. 26, 1993

[54] PROCESS FOR THE MANUFACTURE OF SLIDE FASTENERS

[75] Inventors: Masahide Ozaki, Kurobe; Masanori Uji, Osaka; Makoto Yamazaki; Tatsuo Ito, both of Kurobe, all of Japan

[73] Assignee: Yoshida Kogyo K.K., Tokyo, Japan

[21] Appl. No.: 710,546

[22] Filed: Jun. 5, 1991

[30] Foreign Application Priority Data

Jun. 6, 1990 [JP] Japan ..... 2-147635

[51] Int. Cl.[5] ..... B21D 53/50; A41H 37/06

[52] U.S. Cl. ..... 29/408; 29/766; 29/33.2

[58] Field of Search ..... 29/408, 766, 768, 767, 29/33.2

[56] References Cited

U.S. PATENT DOCUMENTS 2,885,774 5/1959 Waldes .
3,130,476 4/1964 Scheuermann .
3,530,563 9/1970 Maeda ..... 29/207.5
4,932,113 6/1990 Frohlich et al. ..... 29/409

FOREIGN PATENT DOCUMENTS 0417773 3/1991 European Pat. Off. .
1610456 11/1970 Fed. Rep. of Germany .
3712401 10/1988 Fed. Rep. of Germany .
2021982 7/1970 France .
2-74205 3/1990 Japan .

*Primary Examiner*—P. W. Echols
*Attorney, Agent, or Firm*—Hill, Steadman & Simpson

[57] ABSTRACT

A process for the manufacture of slide fasteners from an elongate stringer chain is disclosed in which the stringer chain is maintained in tensionless suspension at predetermined locations along the path of its movement through various stages of production. A plurality of processing units are controlled so as to operate in synchronized relation to one of such units which has a slowest cycle of operation.

3 Claims, 4 Drawing Sheets

PROCESS FOR THE MANUFACTURE OF SLIDE FASTENERS

BACKGROUND OF THE INVENTION

1. Field of the Invention

This invention relates to a process for the manufacture of slide fasteners from an elongate stringer chain. More particularly, the invention is directed to a process for controlling the operation of each of the processing operating units installed serially in a slide fastener manufacturing plant.

2. Prior Art

There are known various control systems for effecting a controlled operation of respective processing units in a slide fastener production line during a substantially continuous cycle of operation. One such prior art process is disclosed for example in Japanese Laid-Open (Kokai) Publication No. 2-74205 for controlling the entire apparatus for making slide fastener products of different lengths, styles, sizes and/or colors. The arrangement of the apparatus is shown in FIG. 4 of the accompanying drawings in which a buffer W or storage device is provided between succeeding machines including a gapping machine P, a bottom stop fitting machine Q, a slider mounting machine R, a top stop fitting machine S and a cutting machine T, the maximum and minimum level of workpiece supply Y in the buffer W being a determining factor to continue or discontinue the operation of the respective upstream and downstream machines. The feeding of the workpiece or stringer chain W through the various machines relies upon the repetitive maximum and minimum levels of the workpiece W in each buffer W. This process therefore has a drawback in that the time required to complete each production cycle is prolonged, that the workpiece W is prone to become tainted or entangled while being stored in the buffers W, and that the workpiece W gets taut when its supply in each buffer W is depleted, resulting sometimes in defective slide fastener products.

SUMMARY OF THE INVENTION

It is therefore a primary object of the present invention to provide a process for the manufacture of slide fasteners which will eliminate the foregoing drawbacks of the prior art and which will enable an automatic mass production of slide fasteners with utmost efficiency and accuracy.

According to a feature of the invention, slide fasteners are produced from an elongate stringer chain which is maintained in tensionless suspension at predetermined locations in the production line.

According to another feature of the invention, the operation of each of a plurality processing units is effected in synchronism with a selected one of the respective units which has a slowest cycle of operation from feeding to processing the stringer chain.

The process of the invention comprises feeding the stringer chain sequentially along a path of processing through a plurality of processing units including a gapping unit, a bottom end stop applying unit, and a combination slider and top end stop applying and stringer chain cutting unit; holding the stringer chain in substantially tensionless condition by allowing it to sag by its own gravity at least over a predetermined slide fastener product length between the gapping unit and the bottom end stop applying unit and between the bottom end stop applying unit and the combination unit; and effecting the operation of each of the gapping unit and the bottom end stop applying unit in synchronism with the combination unit having a slowest cycle of operation.

The above and other objects and features of the invention will appear clear from the following detailed description taken with reference to the accompanying drawings which illustrate some preferred embodiments which the invention may assume in practice.

DETAILED DESCRIPTION OF THE PREFERRED EMBODIMENTS

Figure 2A:
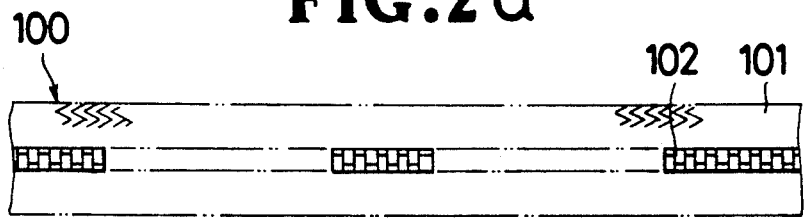
FIGS. 2*a* through 2*e* inclusive are plan views illustrating a slide fastener being processed in respective successive stages of production.

The term stringer chain 100 as used herein designates an elongate strip (FIG. 2*a*) comprising a pair of oppositely disposed tapes 101 and a row of coupling elements 102 secured to and along an inner longitudinal edge of each of the tapes 101.

Figure 1:
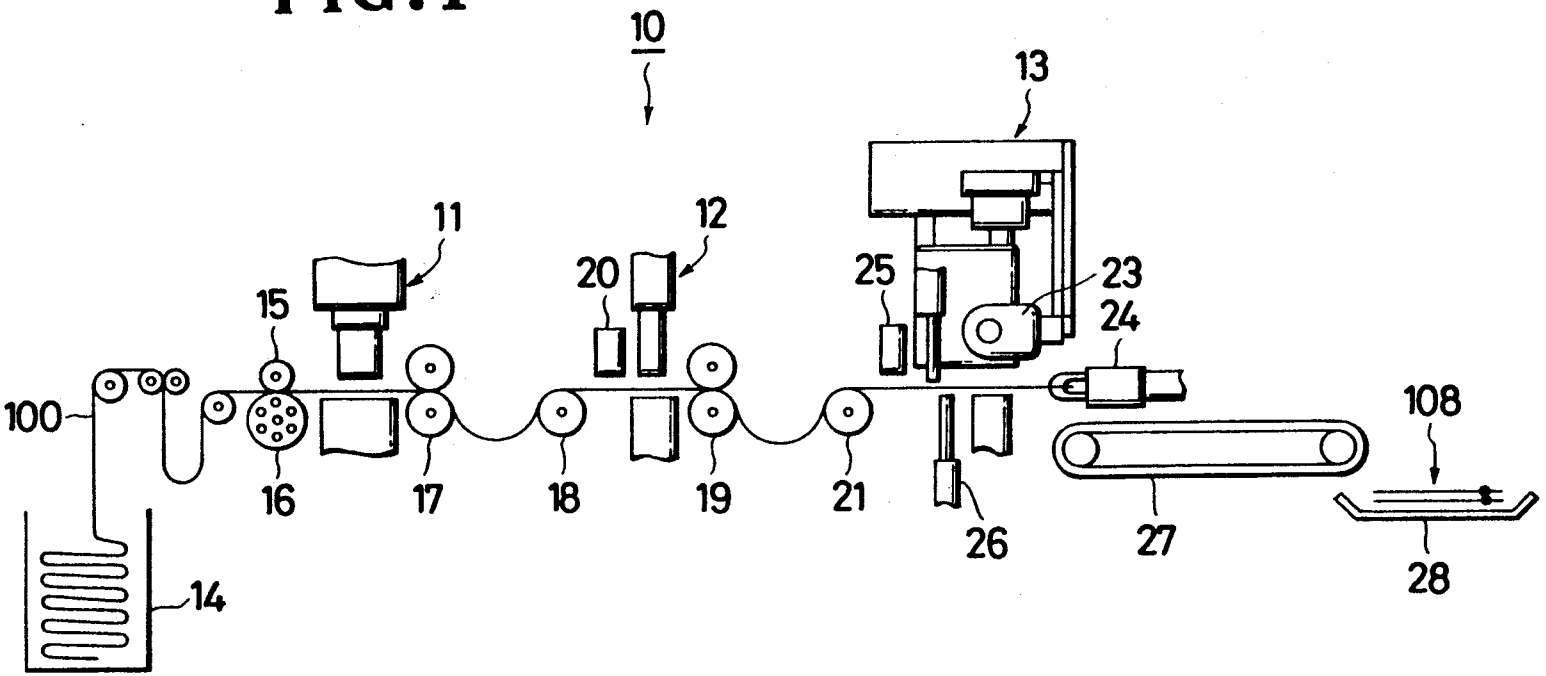
FIG. 1 is a diagrammatic equipment layout illustrating the process of the invention.
Figure 2B:
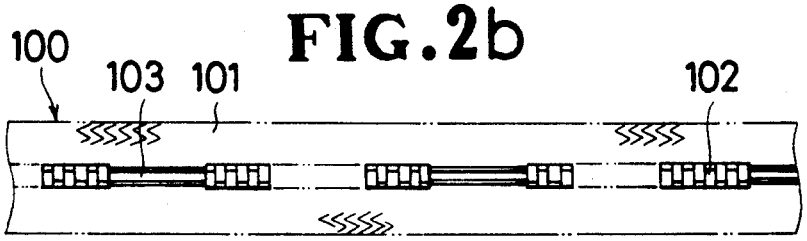

FIG. 1 shows a general layout of an apparatus employed to carry the process of the invention into practice. The apparatus 10 essentially comprises a gapping unit 11 for removing a predetermined number of coupling elements 102 to provide a gap or an element-devoid space portion 103 (FIG. 2*b*); a bottom end stop applying unit 12 for applying a bottom end stop 104 at the trailing end of each gap 103; and a combination unit 13 including a slider applying unit for mounting a slider 105 (FIG. 2*d*) astride the coupling elements 102 on the pair of opposed tapes 101, a top end stop applying unit for applying a top end stop 106 (FIG. 2*d*) at the end of a terminal element 102 on each tape 101, and a cutting unit for cutting the tapes 101 transversely across the center line 107 (FIG. 2*d*) of each gap 103.

The stringer chain 100 is metered, cut to a predetermined length and stored in a stockyard 14 in advance of entry into the processing apparatus 10. The stringer chain 100 passes through a first detector 15 operatively associated with a metering roll 16 and stops upon movement for a distance corresponding to one slide fastener product length, during which time the stringer chain 100 is gapped by the gapping unit 11. This is followed by operation of a first feed roller 17 to advance the stringer chain 100.

Figure 2C:
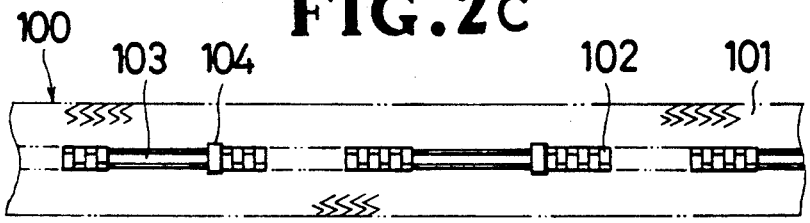

According to an important feature of the invention, the first feed roller 17 is controlled so as to begin its rotation in synchronism with an operating cycle of a slowest processing unit in the apparatus 10 which is the combination slider and top end stop applying and cutting unit 13 as exemplified in the illustrated embodiment. A completion of one operating cycle of the slowest unit 13 (beginning with advancing movement of the stringer chain 100 and ending with attachment of a slider and top end stops onto the chain 100 and cutting the chain 100) dictates the first feed roller 17 to advance or feed the downstream portion of the stringer chain 100 through a first guide roll 18 onto the bottom end stop applying unit 12 and the upstream portion of the chain 100 onto the gapping unit 11. In a manner similar to the first feed roller 17, a second feed roller 19 operates in synchronism with the operating cycle of the slowest unit 13 and draws the stringer chain 100 forwardly onto the bottom end stop applying unit 12. A second detector 20 monitors the movement of the stringer chain 100 for a distance corresponding to one slide fastener product length and dictates the second feed roller 19 to stop so as to allow the unit 12 to apply a bottom end stop 104 to the upstream terminal elements 102 of the stringer chain 100 as depicted in FIG. 2*c*.

According to another feature of the invention, the stringer chain 100 is always held in tensionless condition by allowing it to sag by its own gravity at least over one slide fastener product length between the first feed roller 17 adjacent to the gapping unit 11 and the first guide roll 18 immediately upstream of the bottom end stop applying unit 12 and also between the second feed roller 19 immediately downstream of the bottom end stop applying unit 12 and a second guide roll 21 immediately upstream of the combination unit 13, as illustrated in FIG. 1. The distance over which the stringer chain 100 is held substantially tensionless may be greater than one slide fastener product length where the product is relatively short.

Figure 2D:
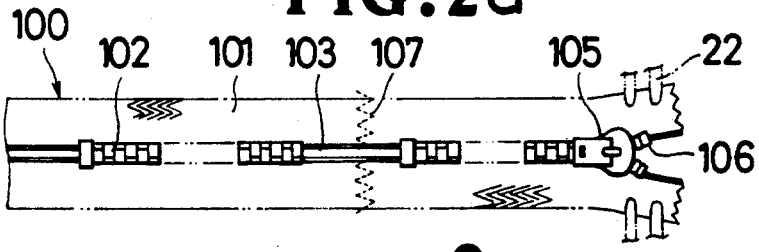
Figure 2E:
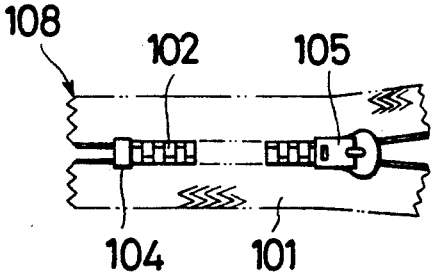

The stringer chain 100 now assembled with a bottom end stop 104 is further advanced by means of feed grippers 22, 22 onto the combination unit 13, wherein the chain 100 is assembled with a slider 105 and top end stops 106 supplied from a parts holder 23. The stringer chain 100 thus assembled with slider 105 and top end stops 106 as depicted in FIGS. 2*d* is gripped and pulled toward an outlet end of the apparatus 10 by a take-out gripper 24 for a distance corresponding to one slide fastener length as detected by a third detector 25, whereupon the stringer chain 100 is cut by a cutter 26 transversely across the cutting line 107 centrally of the gap 103 to produce a finished slide fastener 108 (FIG. 2*e*) which is further carried onward by the gripper 24 over to a conveyor 27, thence to a product tray 28 in which finished slide fasteners are stacked and bundled in a manner well known in the art.

The gaps 103 are utilized for actuating the second detector 20 and the third detectors 25 as for example by a mechanical means such as a pin installed at the gap 103, or by an optical means emitting a light beam through the gap 103 in a manner well known in the art, whereby the detectors 20 and 25 respectively read and signal one predetermined slide fastener product length after another over the stringer chain 100.

Figure 3A:
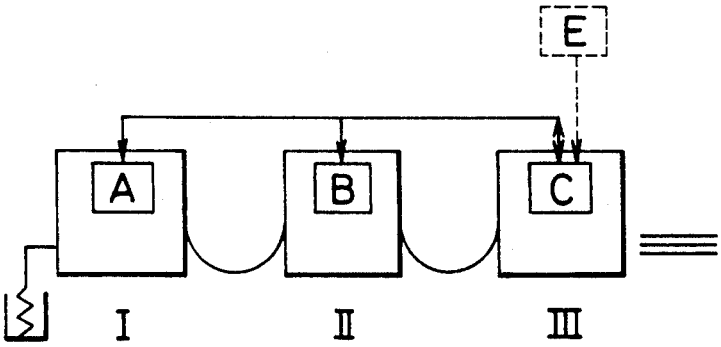
FIGS. 3*a* through 3*c* inclusive are block diagrams utilized to explain three different modes of control of the respective processing units for the manufacture of slide fasteners according to the invention.
Figure 3B:
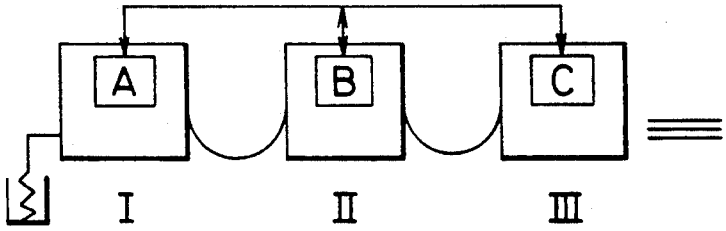
Figure 3C:
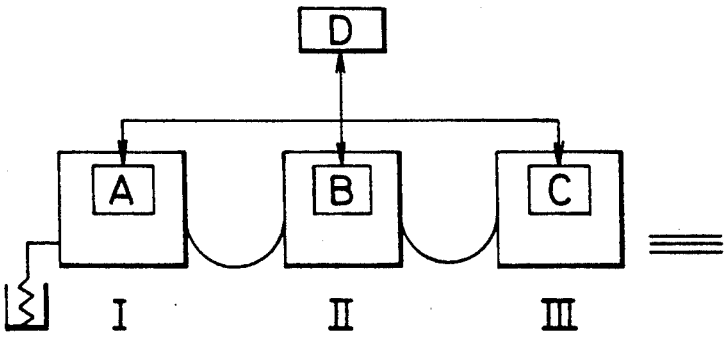
Figure 4:
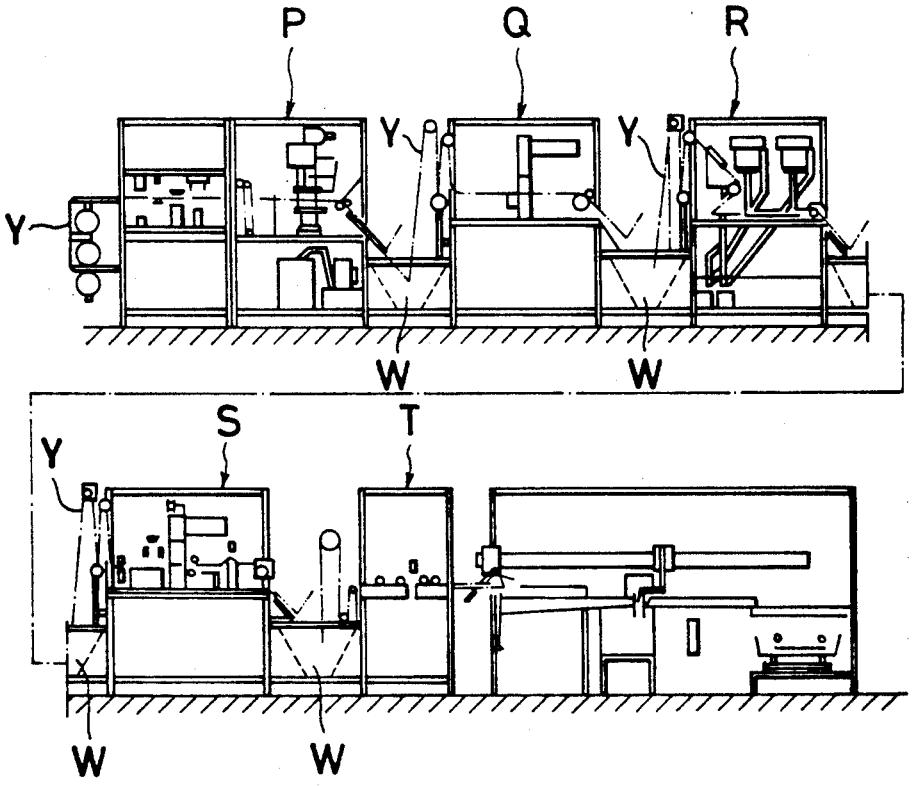
FIG. 4 (PRIOR ART)
FIG. 4 is a small scale side elevational view of a prior art manufacturing system.

The processing units 11, 12 and 13 are controlled for their respective cycles of operation by respective control devices (A), (B) and (C) as schematically illustrated in FIGS. 3*a*–3*c*. FIG. 3*a* shows a mode of control in which the control device (C) associated with the slowest processing unit (III) is arranged to supervise the other two control devices (B) and (C) linked to the processing units (I) and (II), respectively. The cycle of processing operation begins with the transmission of an information signal from each of the control devices (A) and (B) to the master control device (C) that the stringer chain 100 is ready to make advancing or feeding movement. With all of the three units (I), (II) and (III) set up, the master control device (C) transmits an information signal to the control devices (A) and (B), respectively, to initiate feeding of the stringer chain 100, whereupon the units (I) and (II) are put into operation simultaneously and the stringer chain 100 is fed and monitored by the detectors 20 and 25, followed by assembling the chain 100 with the respective slide fastener component parts (bottom end stop 104, slider 105 and top end stops 106) at the respective units (I) and (II). An information signal representing the completion of the work of the respective units (I), (II) and (III) is transmitted from the respective control devices (A), (B) and (C) to the master control (C), whereupon the next cycle of operation begins with the transmission of a "feed-start" signal from the master control (C) to the respective control devices (A) and (B). The processing units (I) and (II) are thus operated in synchronized relation to the slowest working unit (III).

FIG. 3*b* shows another mode of control in which the processing unit (II) is the slowest and hence its associated control device (B) serves as a master to supervise the other two control devices (A) and (C).

FIG. 3*c* illustrates a further mode of control in which a central control device (D) is installed to supervise all of the three control devices (A), (B) and (C) so that the respective processing units (I), (II) and (III) are maintained in synchronized cycle of operation.

Various changes and modifications may be made in the foregoing embodiments of the invention without departing from the spirit and scope of the appended claims. For example, the combination processing unit 13 may be built into separate units for applying sliders 105 and top end stops 106 respectively and cutting the stringer chain 100, thus providing a total of five stages of operation. It is also possible to connect the master control device (C), as shown in FIG. 3*a*, to a computer control system (E) storing a specific production program designed to manufacture a variety of slide fastener products differing in style, length, color, etc., including for example a separable type of bottom end stop. Alternatively, such computer control system (E) may be connected to the central control device (D) for similar purposes.

What is claimed is:

1. In the manufacture of slide fasteners from an elongate stringer chain in which said stringer chain is gapped at predetermined intervals, applied with slider fastener component parts such as a bottom end stop, a slider and top end stops and cut into individual slide fastener products, the process which comprises maintaining said stringer chain in substantially tensionless suspension by allowing it to say by its own weight at predetermined locations along the path of its movement through a plurality of processing stages and effecting the operation of said processing stages in synchronism with a selected one of said stages which has a slowest cycle of operation.

2. The process as defined in claim 1 which further comprises controlling the operation of each of said units with a computer program designed to manufacture slide fasteners differing in style, length and/or color.

3. A process of manufacturing slide fasteners from an elongate stringer chain which comprises feeding said stringer chain sequentially along a path of processing through a plurality of processing units including a gapping unit, a bottom end stop applying unit, and a combination slider and top end stop applying and stringer chain cutting unit; holding said stringer chain in substantially tensionless suspension by allowing it to sag by its own weight at least over a predetermined slide fastener product length between said gapping unit and said bottom end stop applying unit and between said bottom end stop applying unit and said combination unit; and effecting the operation of each of said gapping unit and said bottom end stop applying unit in synchronism with said combination unit having a slowest cycle of operation.

* * * * *